US008740265B2

(12) United States Patent
Gillis

(10) Patent No.: US 8,740,265 B2
(45) Date of Patent: Jun. 3, 2014

(54) DUAL PAWL LATCH MECHANISM FOR A DUAL DOOR ASSEMBLY

(71) Applicant: Ford Global Technologies, LLC, Dearborn, MI (US)

(72) Inventor: Francis Raymond Gillis, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/780,086

(22) Filed: Feb. 28, 2013

(65) Prior Publication Data

US 2014/0062103 A1 Mar. 6, 2014

Related U.S. Application Data

(60) Provisional application No. 61/694,978, filed on Aug. 30, 2012.

(51) Int. Cl.
*E05C 3/16* (2006.01)

(52) U.S. Cl.
USPC ..... 292/214; 292/199

(58) Field of Classification Search
USPC ..... 292/194, 214, 280, DIG. 4, DIG. 37; 296/24.34, 37.8; 49/503
See application file for complete search history.

(56) References Cited

U.S. PATENT DOCUMENTS

| | | | | |
|---|---|---|---|---|
| 5,680,974 | A * | 10/1997 | Vander Sluis | 224/281 |
| 6,217,087 | B1 * | 4/2001 | Fuller | 292/39 |
| 7,407,200 | B2 * | 8/2008 | Ichimaru | 292/194 |
| 2004/0227349 | A1 * | 11/2004 | Denys | 292/26 |
| 2006/0097534 | A1 * | 5/2006 | Adams et al. | 296/37.1 |
| 2009/0230699 | A1 * | 9/2009 | Carabalona | 292/48 |
| 2011/0025074 | A1 * | 2/2011 | Reznar | 292/33 |

FOREIGN PATENT DOCUMENTS

JP 11278514 A * 10/1999

* cited by examiner

*Primary Examiner* — Kristina Fulton
*Assistant Examiner* — Christine M Mills
(74) *Attorney, Agent, or Firm* — Vichit Chea; Price Heneveld LLP

(57) ABSTRACT

A latch mechanism used in conjunction with a dual door access system, wherein the dual door access system is actuated between a latched position and an open position by the latch mechanism using a dual pawl design which is configured such that each door in the dual door access system has its own dedicated latch pawl within the latch mechanism for retaining the doors in the latched position.

9 Claims, 19 Drawing Sheets

DUAL PAWL LATCH MECHANISM FOR A DUAL DOOR ASSEMBLY

CROSS-REFERENCE TO RELATED APPLICATION

This application claims priority to and the benefit under 35 U.S.C. §119(e) of U.S. Provisional Patent Application No. 61/694,978, filed on Aug. 30, 2012, entitled "DUAL PAWL LATCH MECHANISM FOR A DUAL DOOR ASSEMBLY," the entire disclosure of which is hereby incorporated by reference.

FIELD OF THE INVENTION

The present invention generally relates to a latch mechanism for use in a console disposed in a vehicle interior, and more particularly, to a latch mechanism used in conjunction with a dual door console access system, wherein the dual door console access system is actuated between a closed or latched position and an open position. The latch mechanism employs a dual pawl design which is configured such that each individual door in the dual door access system has a dedicated latch pawl within the latch mechanism for separately retaining each door in the latched position. The dedicated latching of each door separately provides a dual door access system exhibiting reduced deflection between the doors as latched.

BACKGROUND OF THE INVENTION

Dual door access systems are used within vehicle interiors to provide access to console features such as trays, storage compartments, cup holders and the like. When using a dual door access system it is desirable to couple the doors in a gear train arrangement, such that the door movement between door assemblies is mirrored or in concert. Further, it is desirable to provide a dual access door system wherein the doors remain latched and in proper position when closed, such that outside forces acting on the doors' exterior surfaces do not cause undue deflection in the doors. Door deflection causes for undesirable gaps to be formed between door assemblies that exceed asthetic standards. Further, undue deflection provides a poor quality feel and appearance. Thus, it is desirable to provide a dual door access system having a latch mechanism that can retain the doors in their latched state and withstand or reduce deflection under outside forces as imparted on the doors.

The present invention provides a dual pawl system which operates with a single push button actuation mechanism disposed on one door of a dual door access system, such that the push button mechanism actuates with the door between open and closed positions, and further wherein, each door has a dedicated latch pawl to separately retain each door assembly in place with reduced potential for deflection.

SUMMARY OF THE INVENTION

One aspect of the present invention includes a latching mechanism for a vehicle interior, wherein the latching mechanism includes first and second doors which are operable between open and closed positions about a cup holder or other like storage compartment. The first and second doors include forward and rearward pivot arms which couple the first and second doors to a housing. The forward pivot arms of each door assembly include latch strikers which are adapted to engage first and second latch pawls of a latch mechanism when the doors are in a closed position. The latch strikers on the pivot arms of the door assemblies are coupled to the housing and biased by torsion springs, such that when the latch mechanism is activated to release the doors from a latched position, a latch actuator retracts a pair of latch pawls such that the pivot arms are free to rotate in a direction as biased by the torsion springs, such that the first and second door assemblies open to provide access to the storage compartment.

Another aspect of the present invention includes a latch mechanism for a console compartment comprising a console housing having an actuator coupled thereto, wherein the actuator includes first and second pawl assemblies which are slidably supported on the actuator between latched and unlatched positions. First and second pivot arms are rotatably coupled to the console housing and are operable between open and closed positions. Each pivot arm includes a latch striker which is engageable with one of the pawl assemblies such that when the latch striker is engaged with one of the pawl assemblies, the pivot arm is retained in a closed position.

Yet another aspect of the present invention includes a latch mechanism for a console compartment comprising first and second pivot arms rotatably coupled to the console compartment and operable between open and closed positions. Each pivot arm includes a latch striker. An actuator is coupled to the console compartment and moveable between first and second positions. Pawl assemblies are supported on the actuator between latched and unlatched positions and are adapted to separately engage the latch strikers of the pivot arms in the latched position.

Yet another aspect of the present invention includes a latch mechanism for a console compartment comprising a console housing having first and second console doors coupled to and supported therefrom by first and second support arms. The first and second support arms are rotatably coupled to the console housing at circular ends such that the first and second doors are operable between open and closed positions. Latch strikers are disposed on each circular end of the first and second support arms, wherein the latch strikers extend outwardly from the circular ends. An actuator is coupled to the console housing and includes first and second pawl assemblies which are slidably supported on the actuator between latched and unlatched positions. Each latch striker is associated with one of the first and second pawl assemblies such that each latch striker is adapted to engage the associated pawl assembly when the pawl assemblies are in the latched position, thereby providing a dedicated retaining mechanism for each of the first and second console doors.

These and other aspects, objects, and features of the present invention will be understood and appreciated by those skilled in the art upon studying the following specification and appended drawings.

DETAILED DESCRIPTION OF THE PREFERRED EMBODIMENTS

Figure 1:
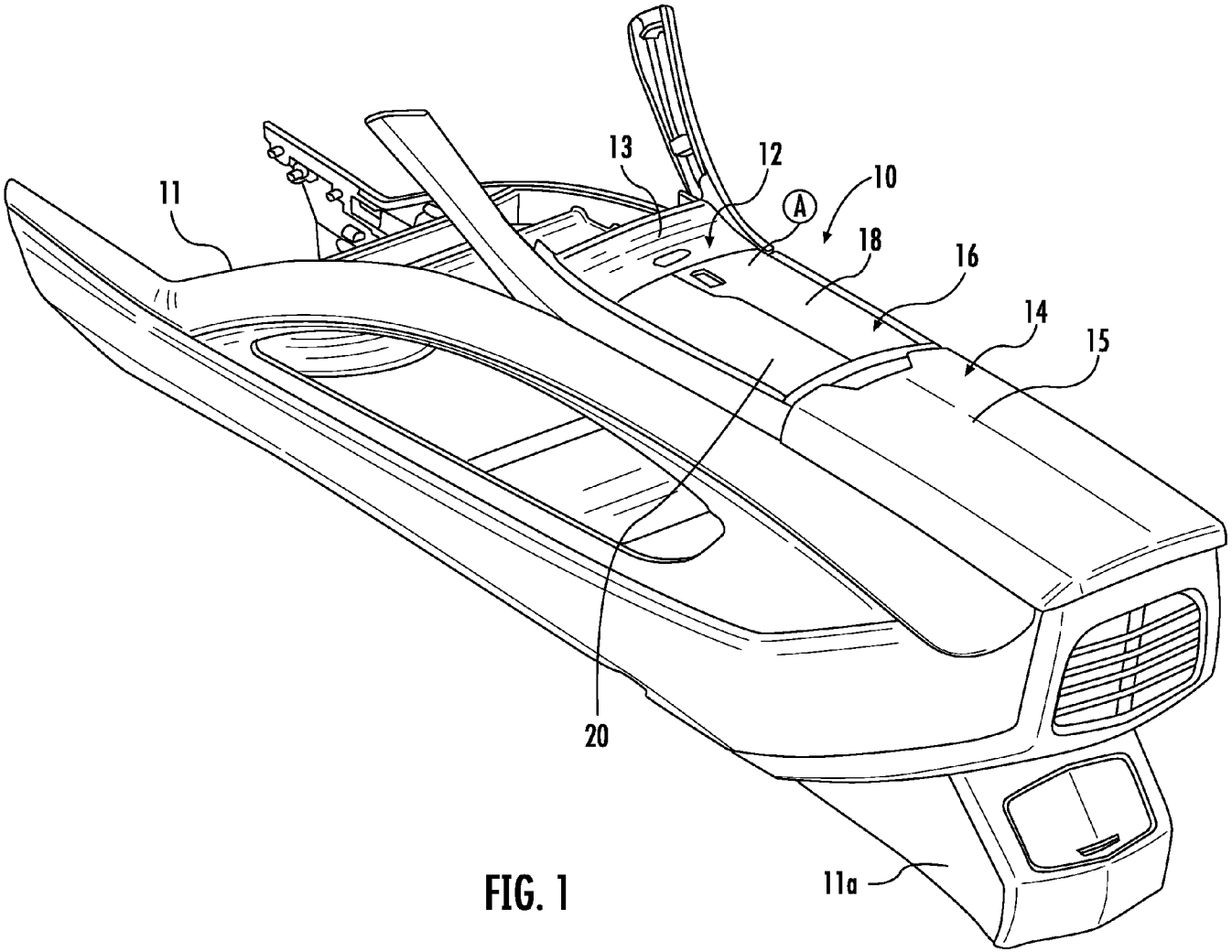
FIG. 1 is perspective view of a center console assembly.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the present disclosure. Hence, specific dimensions and other physical characteristics relating to the embodiments disclosed herein are not to be considered as limiting, unless expressly stated otherwise.

Figure 2:
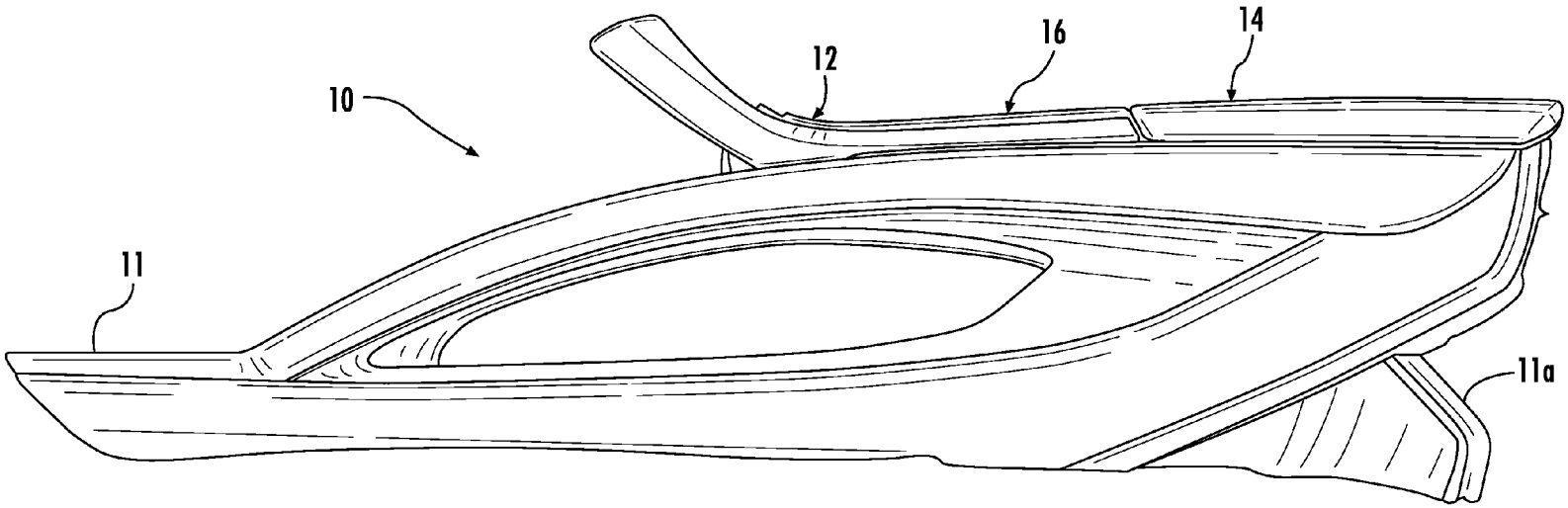
FIG. 2 is a side elevational view of the console assembly of FIG. 1.
Figure 3:
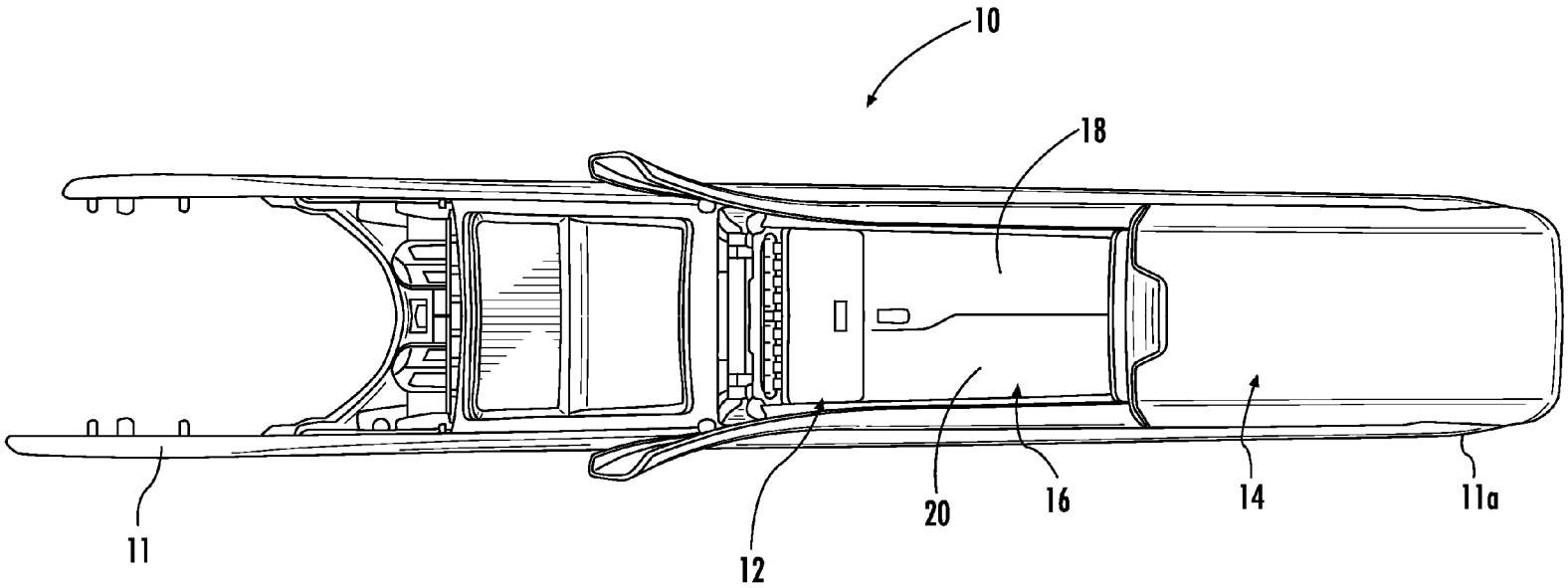
FIG. 3 is a top plan view of the console assembly of FIG. 1.
Figure 4:
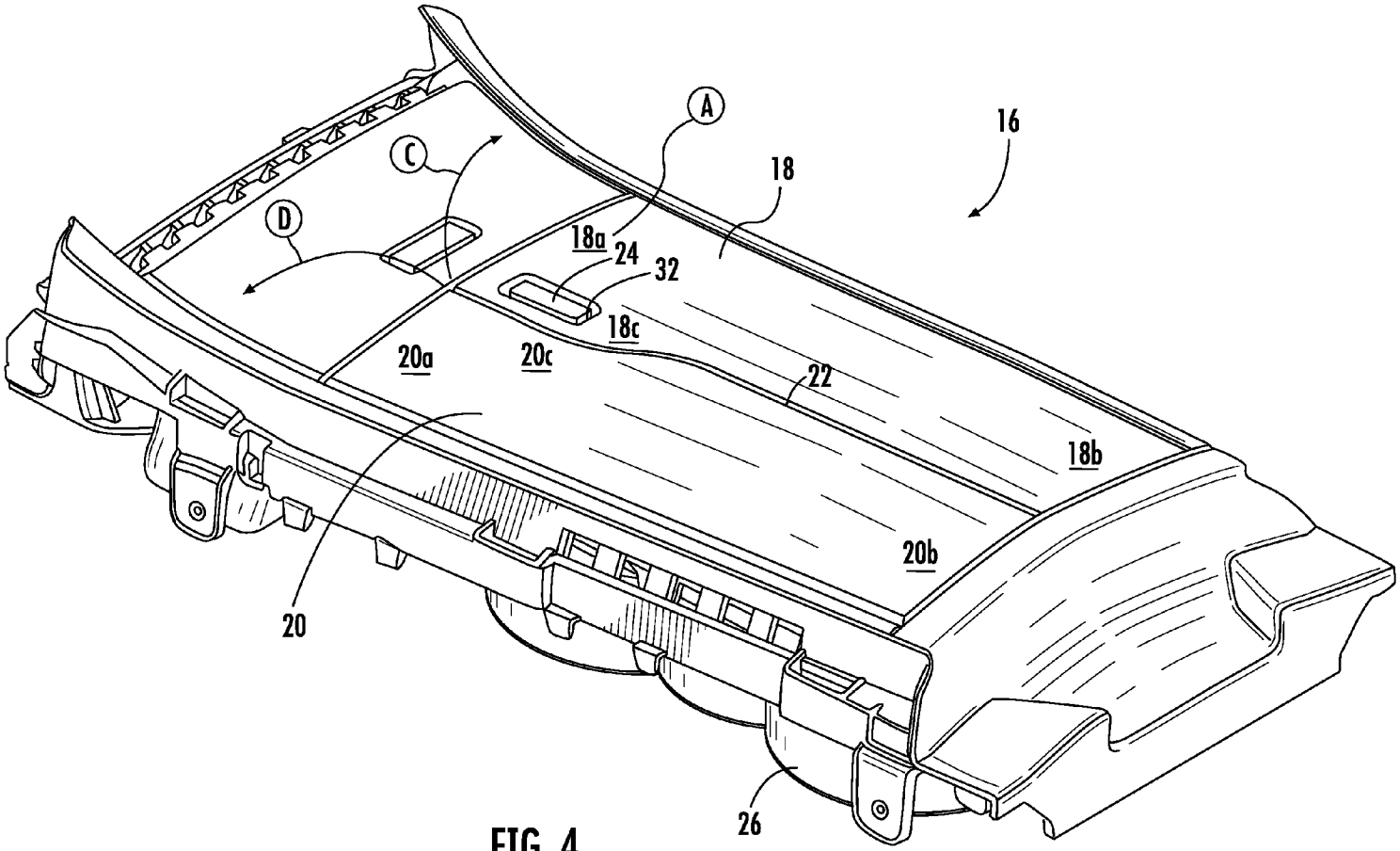
FIG. 4 is a perspective view of a cup holder assembly.
Figure 7:
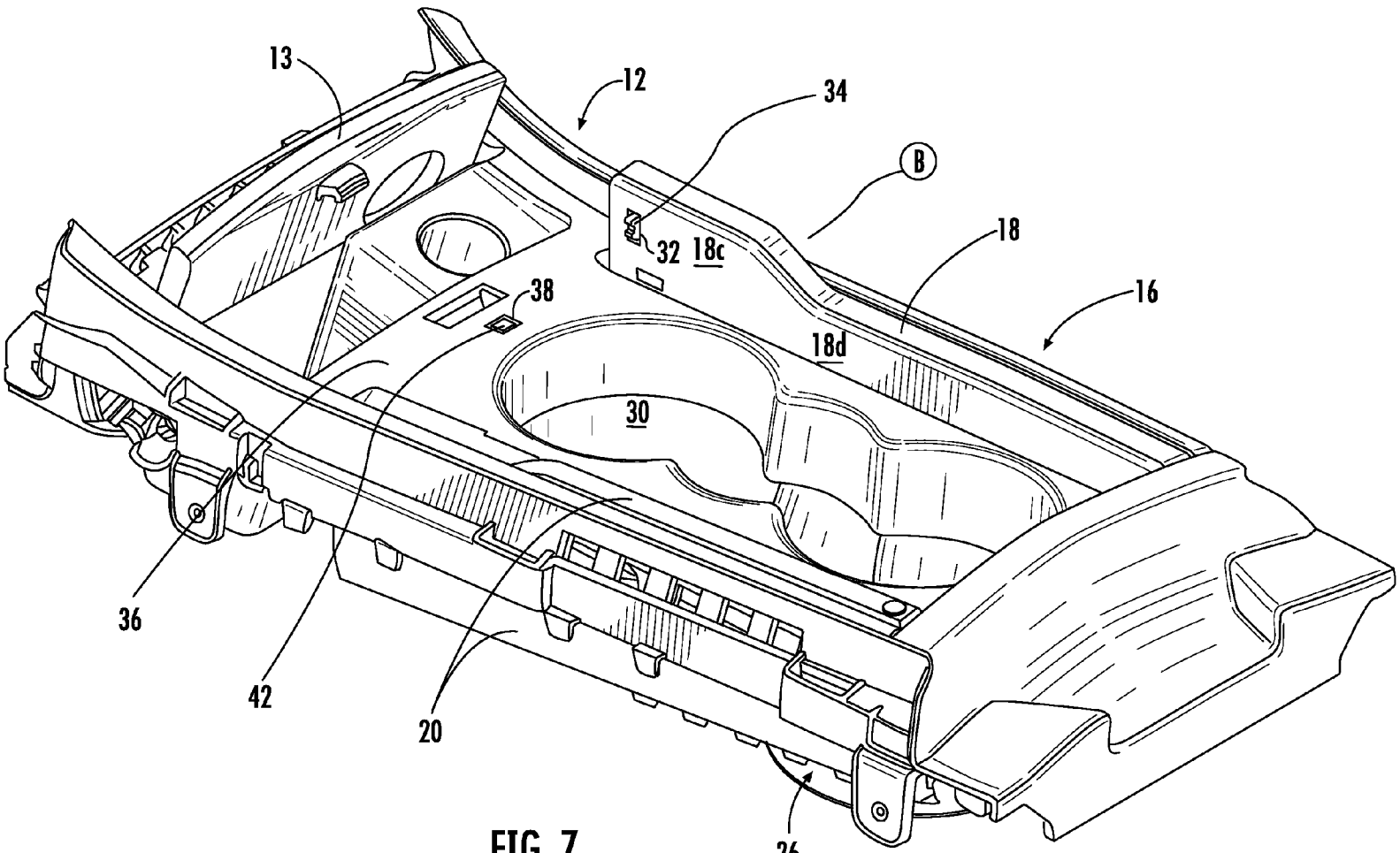
FIG. 7 is a perspective view of the cup holder assembly of FIG. 4 in an open position.

Referring to FIG. 1, the reference numeral 10 generally designates a console assembly, which is adapted to be disposed in the center of a vehicle interior generally between the driver side and passenger side seats. The console assembly 10, as shown in FIGS. 1-3, generally includes a tray 12, a compartment 14, and a cup holder assembly 16. In this embodiment, the tray 12 includes a cover 13, and the compartment 14 also includes a cover 15. The cup holder assembly 16 includes a right hand "master" door 18 and a left hand "slave" door 20 which are operable between a closed position A, as shown in FIGS. 1 and 4, and an open position B, as shown in FIG. 7. The console assembly 10 has a car-forward first end 11 and a car-rearward second end 11*a*, such that the right hand master door 18 is disposed on a right side of the console assembly, and the left hand slave door 20 is disposed on the left hand side of the console assembly 10 as viewed by a vehicle occupant seated on a driver's side of the console assembly 10. While the present invention may be used to provide access to a variety of vehicle interior components, the present disclosure will describe and exemplify the use of the present invention as an access and concealment system on a cup holder assembly 16, which is not intended to limit the scope of the present invention in any way.

Figure 5:
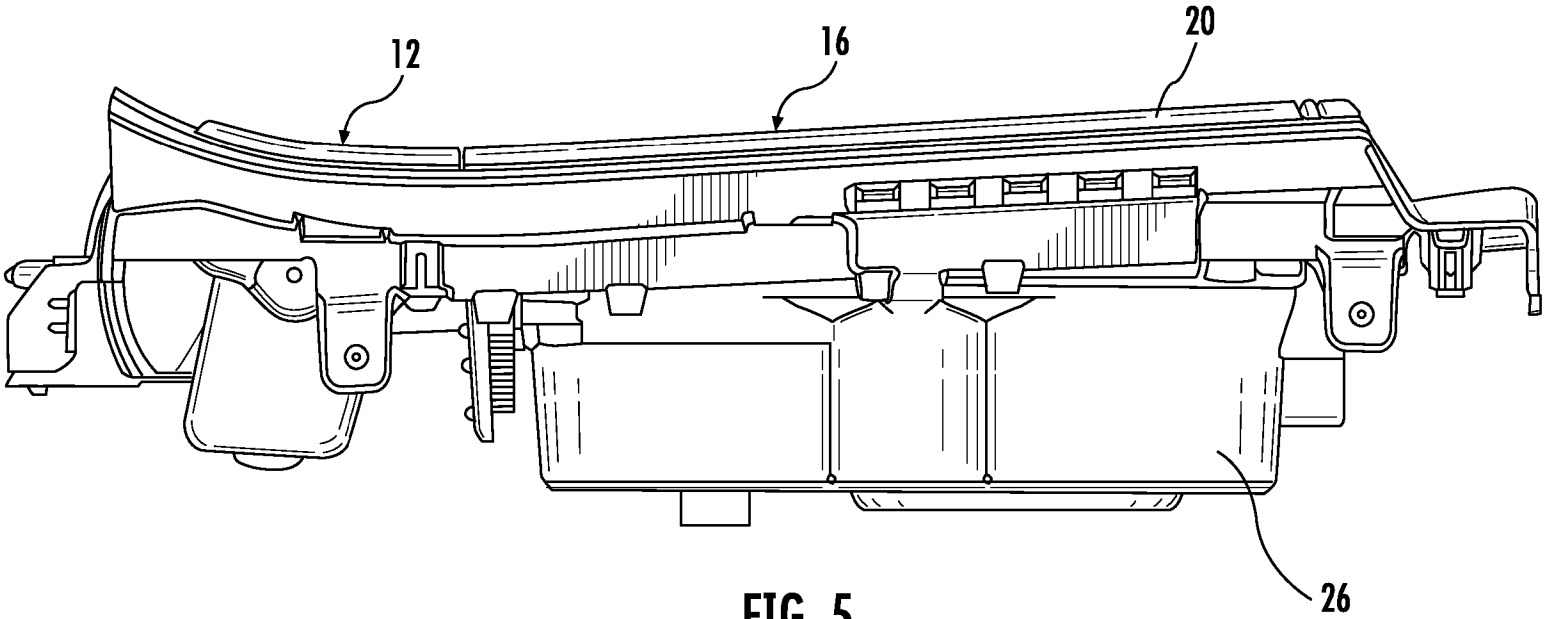
FIG. 5 is a side elevational view of the cup holder assembly of FIG. 4.
Figure 6:
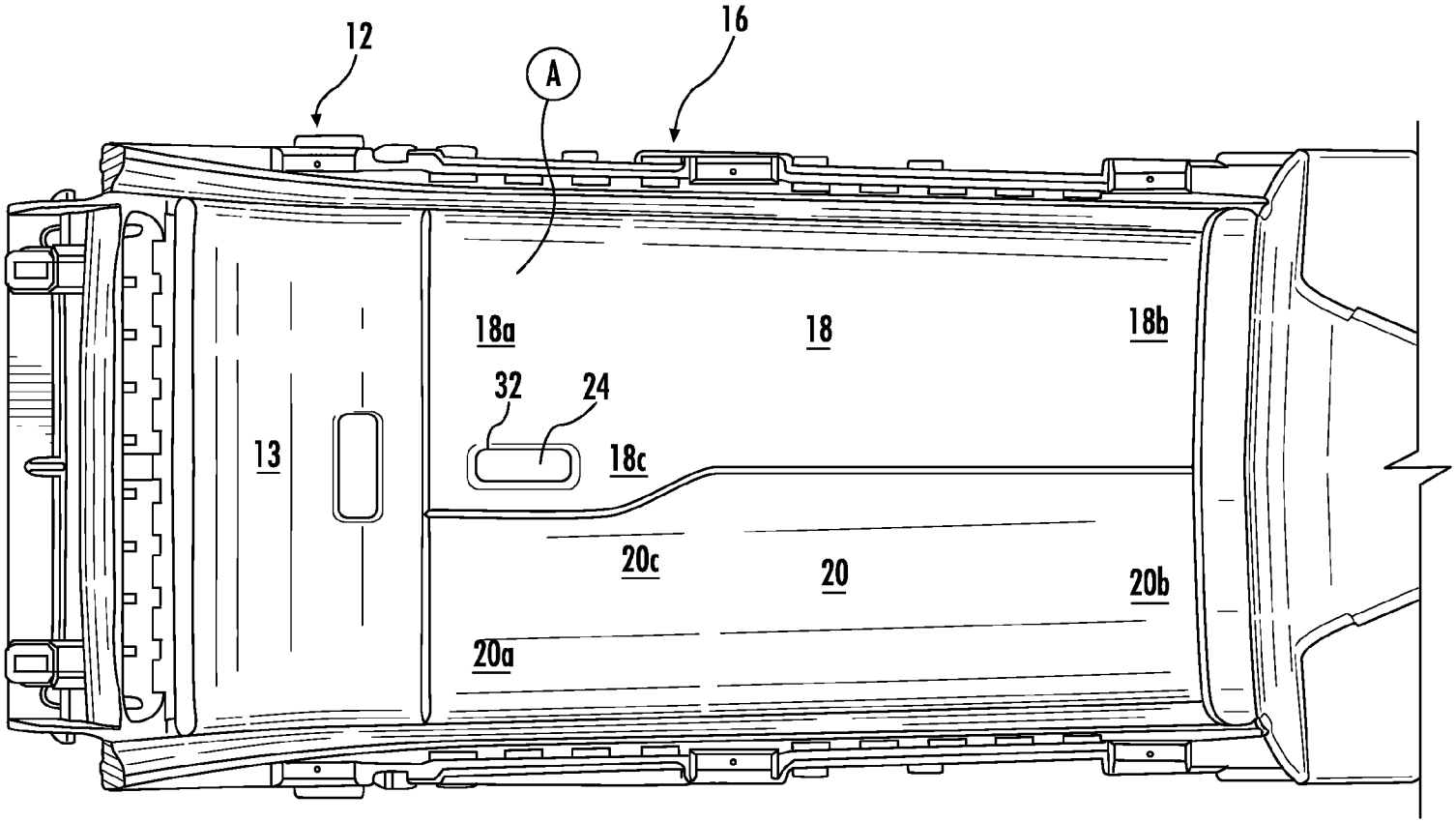
FIG. 6 is a top plan view of the cup holder assembly of FIG. 4.
Figure 8:
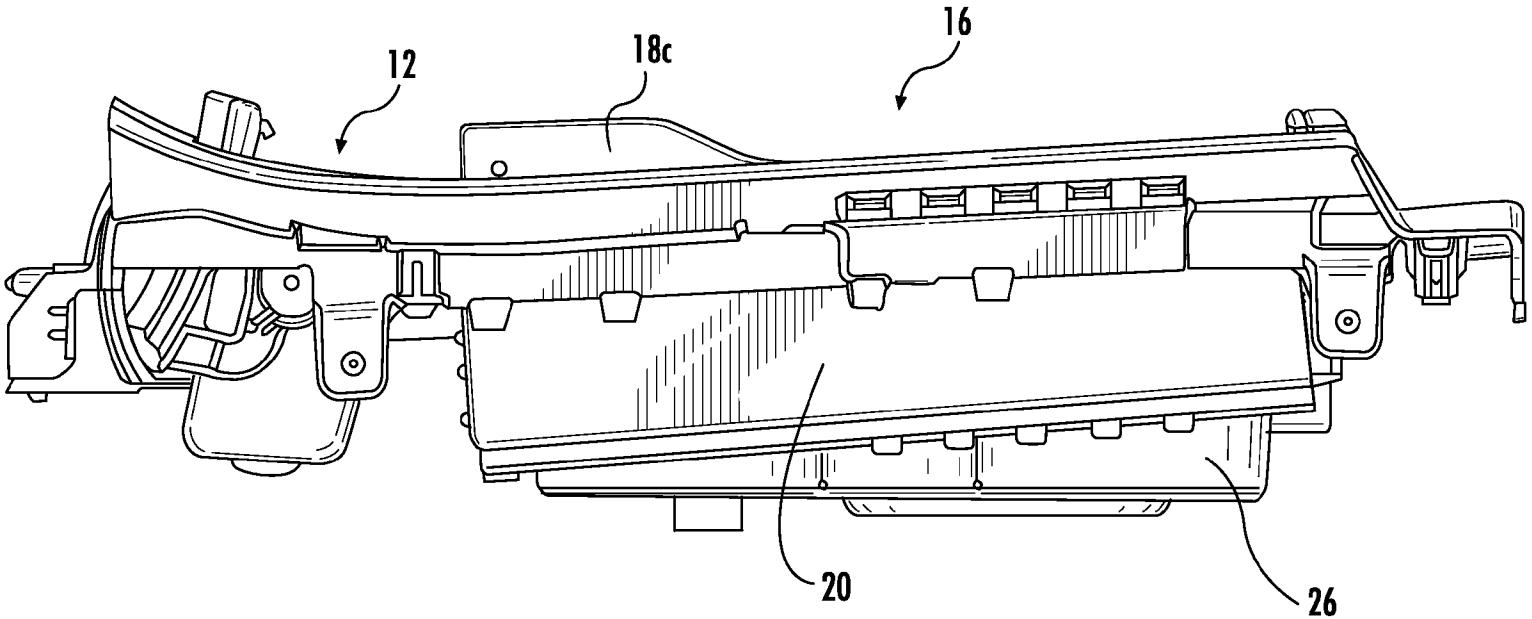
FIG. 8 is a side elevational view of the cup holder assembly of FIG. 7.

As shown in FIG. 4, the cup holder assembly 16 has right and left "bomb bay" style console doors 18, 20 which have car-forward ends 18*a*, 20*a* and car-rearward ends 18*b*, 20*b*. A gap 22 is disposed between the right and left hand console doors 18, 20 disposed along an interior length thereof. The right hand master door 18, as shown in FIG. 4, comprises a jogged or protruding section 18*c*, which carries over into the front portion 20*a* of the left hand slave door 20. The left hand slave door 20 has a recess 20*c* which is complimentary to the jogged portion 18*c* of the right hand master door 18, such that jogged portion 18*c* effectively nests in the recess 20*c* of slave door 20. As shown in FIG. 4, the jogged portion 18*c* of the master door 18 comprises an actuator button 24, which is disposed in an aperture 32 and is substantially housed with an interior or body portion of master door 18. In operation, the actuator button 24 is used to actuate a latch mechanism, as further described below, to open the cup holder assembly 16 from the closed or latched position A (FIG. 1). Generally, when the actuator button 24 is actuated by a user, the console doors 18, 20 open as indicated by arrows C and D respectively to provide access to the cup holder 16. As shown in FIGS. 5 and 8, the cup holder assembly 16 comprises a cup holder or console housing 26 which is shown covered by console doors 18, 20 in the latched position A in FIG. 6.

Figure 9:
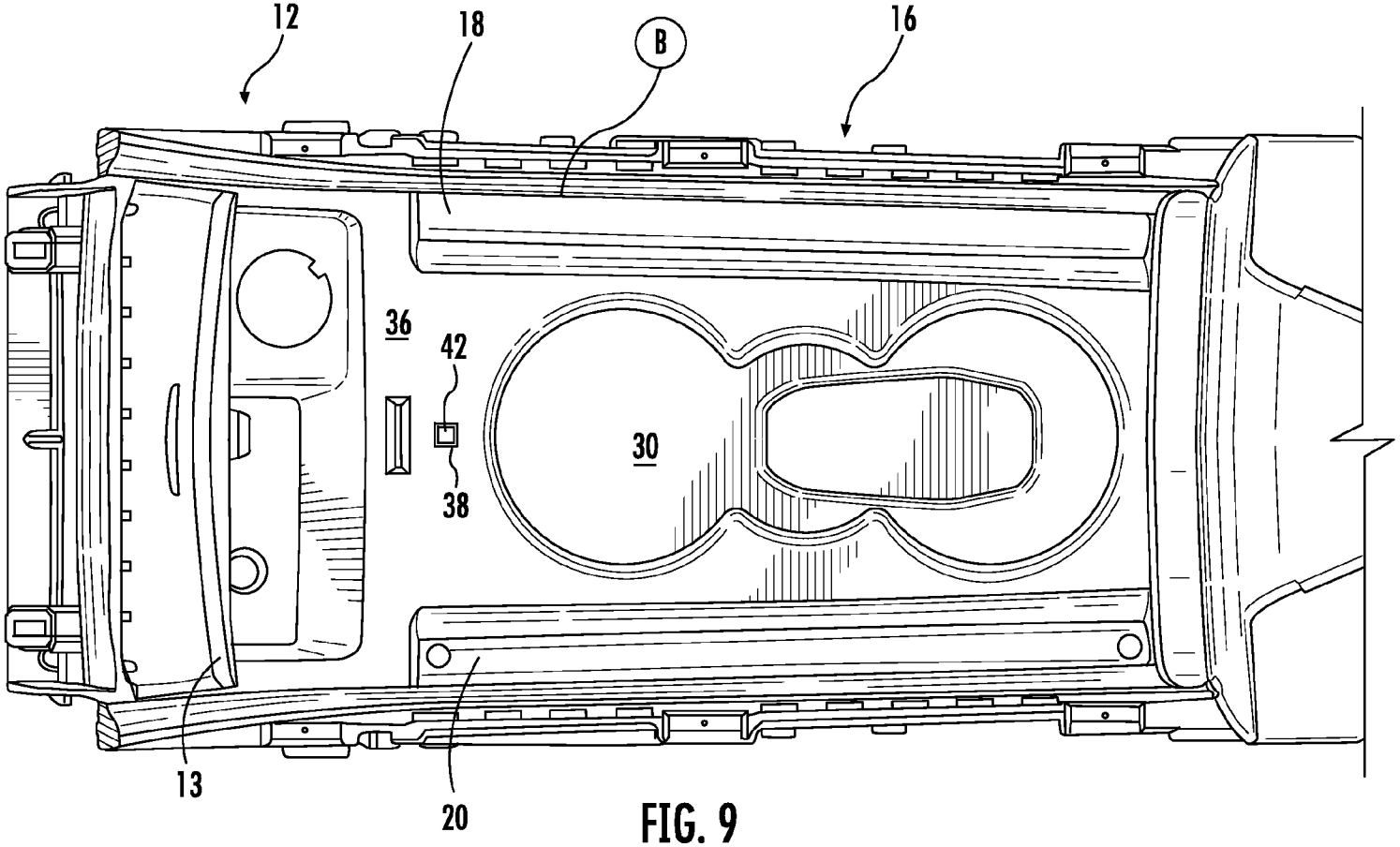
FIG. 9 is a top plan view of the cup holder assembly of FIG. 7.
Figure 14:
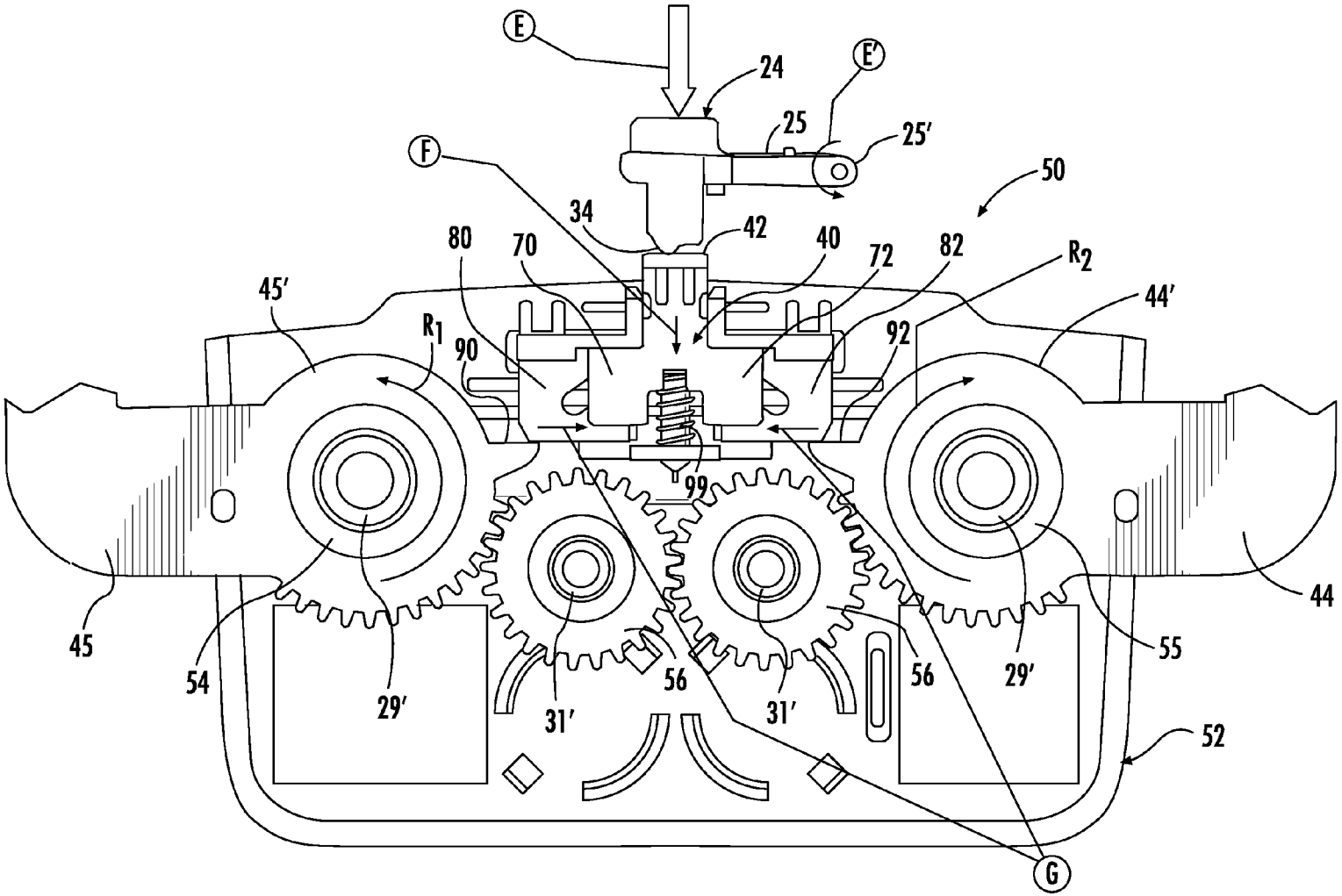
FIG. 14 is a fragmentary front elevational view of a latch mechanism for a cup holder assembly according to one embodiment of the present invention with the latch mechanism in a latched position.

Referring now to FIGS. 7 and 9, the console doors 18, 20 are in an open position B thereby providing access to the cup holder interior 30. As shown in FIG. 7, the master right hand door 18 has an aperture 32 which, in assembly, houses the actuator button 24 such that an actuator contact portion 34 of the actuator button 24 is disposed on interior side 18*d* of master door 18. As shown in FIG. 7, the cup holder housing 26 generally comprises a planar portion 36 having an aperture 38 disposed thereon in which an upper contact surface 42 for a latch actuator 40, FIG. 14, is disposed. Therefore, in assembly, the actuator button 24 is disposed through the body portion of the master door 18 in aperture 32, such that the actuator button 24 has a contact portion 34 which is disposed and aligned with aperture 32 on the interior or underside 18*d* of master door 18. In assembly, the contact portion 34 of the actuator button 24 is aligned with and capable of contacting upper contact surface 42 as disposed in aperture 38 of the cup holder housing 26. The actuation of the latch actuator 40 (FIG. 14) by the actuator button 24, allows the right and left console doors 18, 20 to open into the fully open position B as shown in FIG. 7 and further described below.

Figure 10:
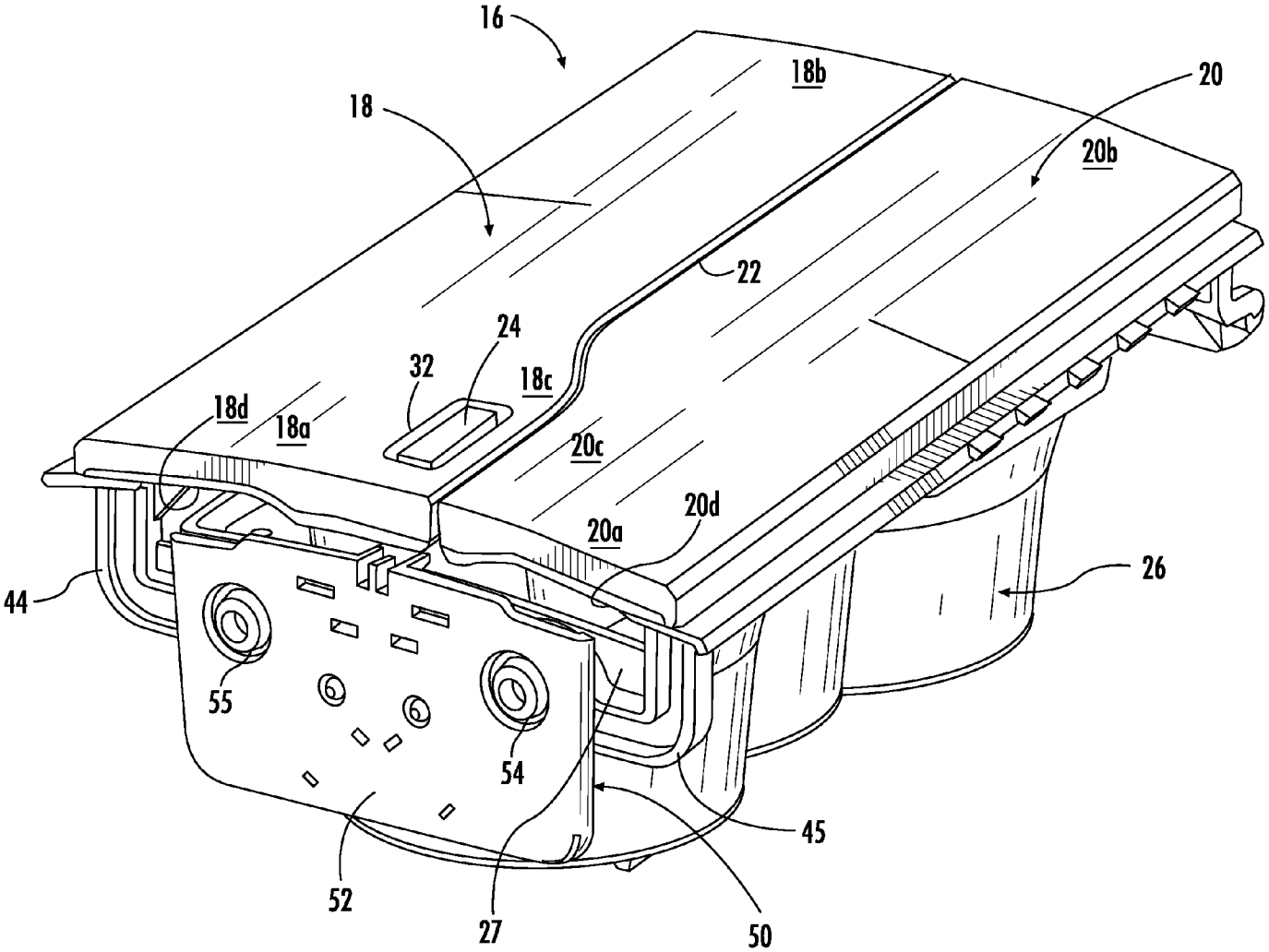
FIG. 10 is a front perspective view of a cup holder assembly and a latch mechanism of the present invention.
Figure 11:
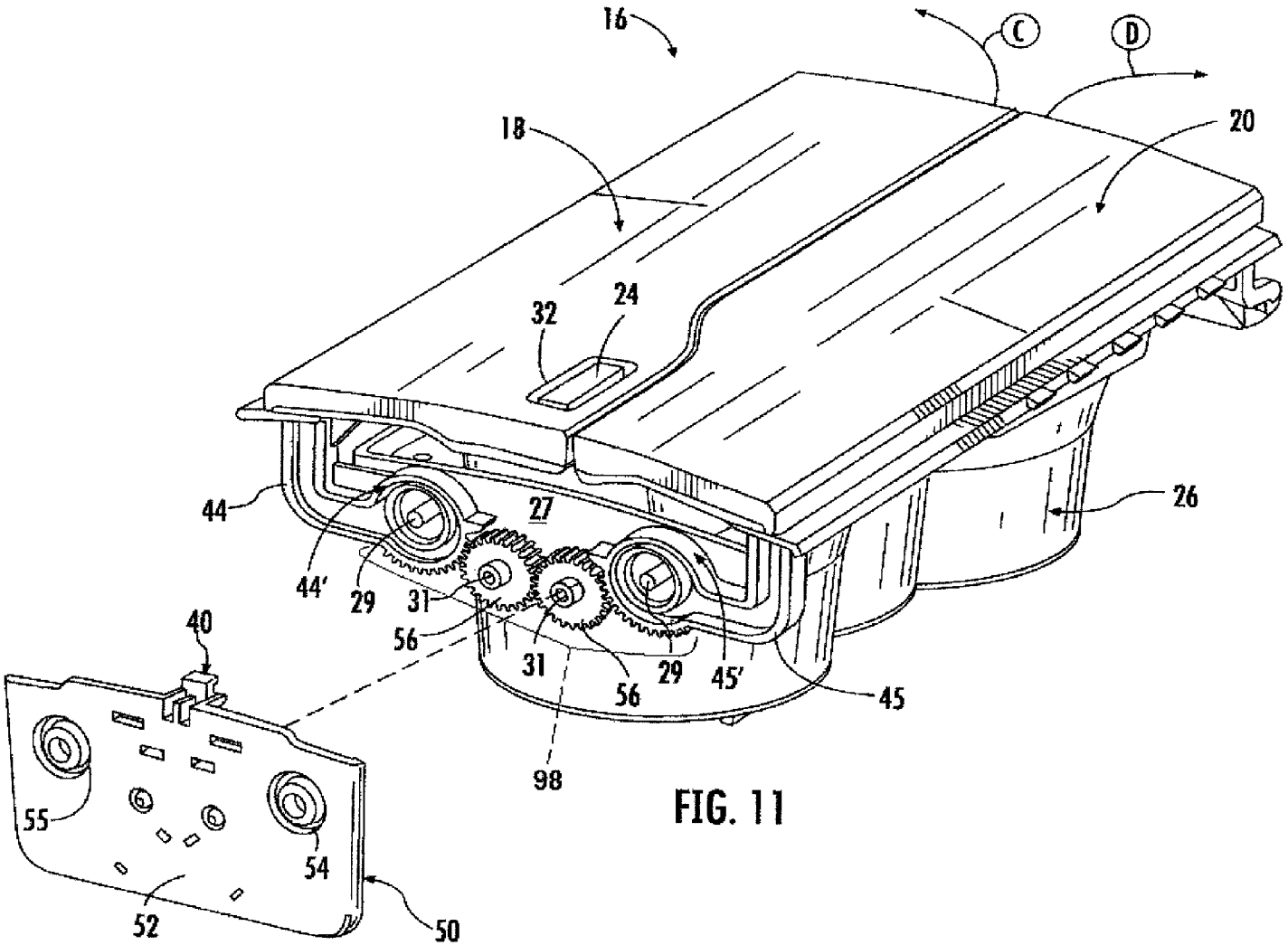
FIG. 11 is a exploded front perspective view of the cup holder assembly and the latch mechanism of FIG. 10.

Referring now to FIG. 10, a cup holder assembly 16 is shown with a latch mechanism 50 disposed at a car-forward end of the cup holder 16. The console doors 18, 20 have L-shaped pivot arms 44, 45, respectively, which are coupled to the interior or underside surface 18*d*, 20*d* of each console door 18, 20. The L-shaped pivot arms 44, 45 are coupled to the latch mechanism 50 at coupling landings 54, 55 disposed on a latch plate 52. As shown in FIG. 11, the latch mechanism 50 is exploded away from the cup holder assembly 16 such that the L-shaped pivot arms 44, 45 are clearly shown. The cup holder housing 26 has a car-forward front plate 27 having spindles 29 disposed thereon. In assembly, the spindles 29 align with and couple to circular ends or door pivots 44' and 45' of the L-shaped pivot arms 44, 45. In this way, the L-shaped pivot arms 44, 45 are pivotally coupled to the cup holder housing 26, such that the console doors 18, 20 can rotate between open and closed positions. The front plate 27 of the cup holder housing 26 further comprises spindles 31 which are adapted to rotatably receive cogs 56 which serve to couple the console doors 18, 20 together in a gear train configuration as further described below.

Figure 12:
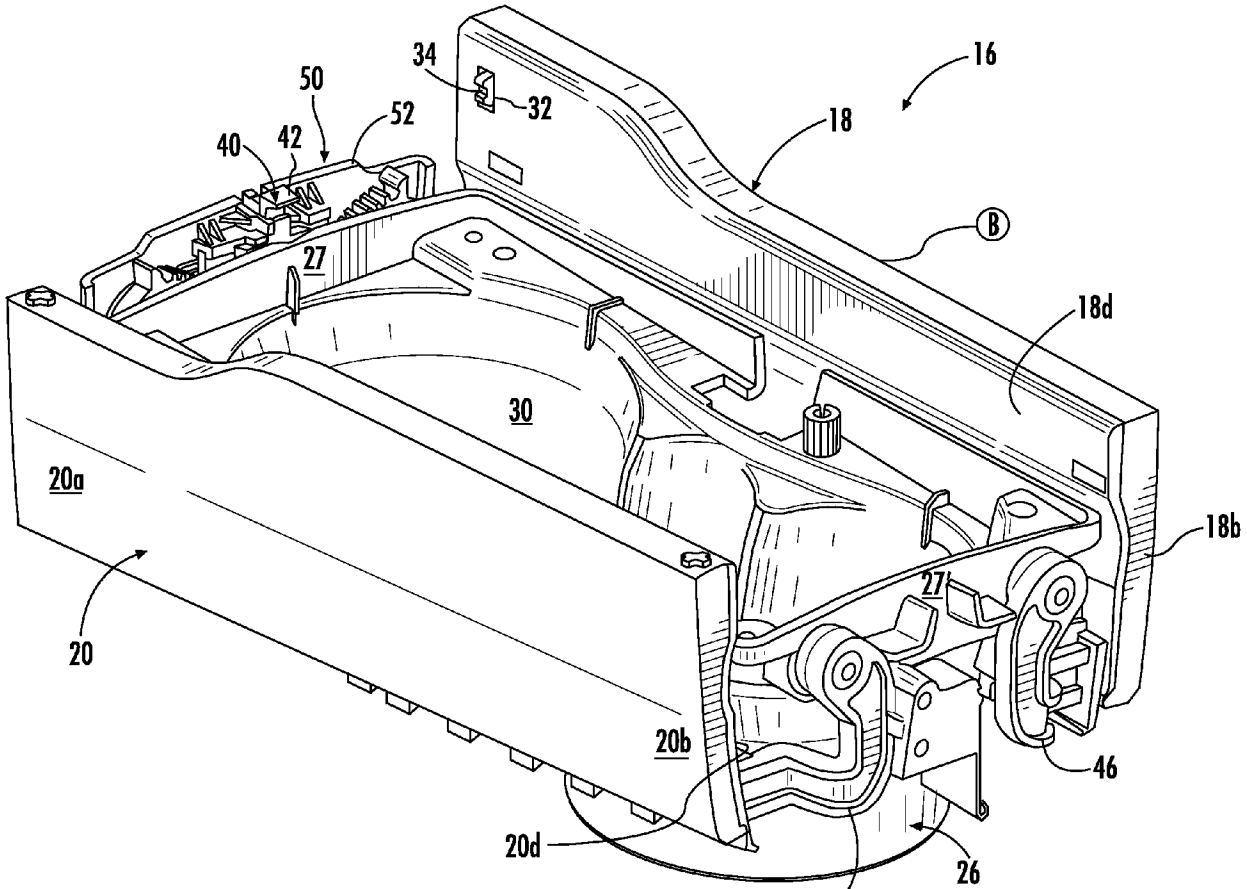
FIG. 12 is a rear perspective view of the cup holder assembly and latch mechanism of FIG. 10.
Figure 13:
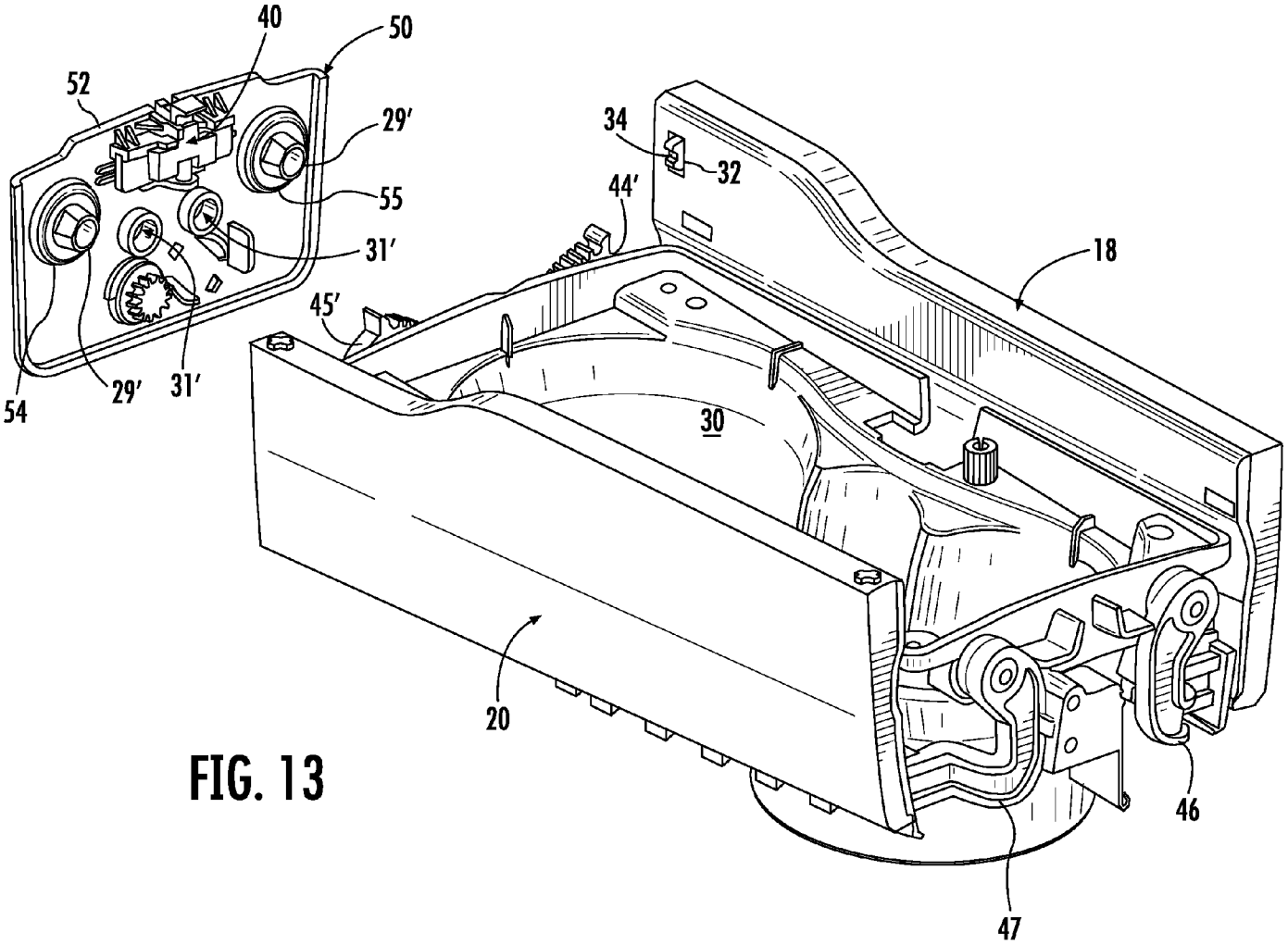
FIG. 13 is an exploded rear perspective view of the cup holder assembly and latch mechanism of FIG. 10.

As shown in FIG. 12, the car-rearward ends 18*b*, 20*b* of the console doors 18, further comprise L-shaped pivot arms 46, 47 which extend therefrom and are pivotally coupled to a car-rearward end 27' of the cup holder housing 26. Together, the L-shaped pivot arms 44, 45, 46 and 47 serve to couple the console doors 18, 20 in a rotatable fashion to the cup holder housing 26 such that the console doors 18, 20 can articulate between open and closed positions along directional arrows C and D as noted above. As shown in FIG. 13, the latch mechanism 50 is exploded away from the cup holder assembly 16 and coupling landings 54, 55 are better shown having projections 29' which are adapted to couple to and encase spindles 29 (FIG. 11) disposed on the front plate 27 of the cup holder housing 26. The latch plate 52 further comprises projections 31' which are adapted to couple to spindles 31, thereby securing cogs 56 to the housing 26 as shown in FIG. 11. In this way, the latch plate 52 couples to the housing 26 of the cup holder assembly to encase the gear train 98 of the dual console doors 18, 20 of the cup holder assembly 16.

Figure 15:
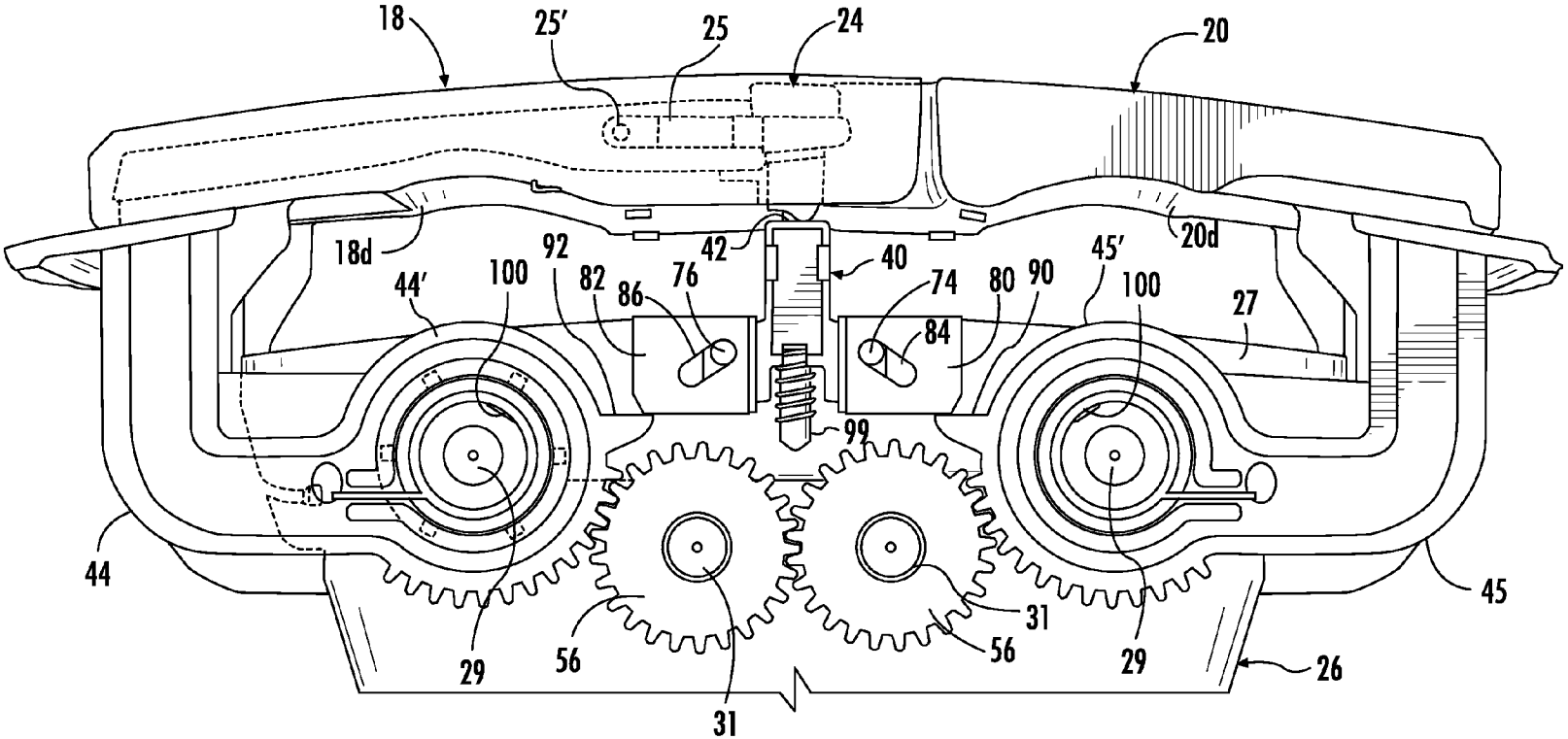
FIG. 15 is a fragmentary front elevational view of a latch mechanism in a latched position with the doors of the cup holder assembly in a closed position.

Turning now to FIG. 14, the latch mechanism 50 is shown from an interior view of the latch plate 52 as connected to the cup holder assembly 16. As shown in FIG. 14, the actuator button 24 has an arm 25 with a coupling portion 25' that is adapted to pivotably couple to the master door 18 in assembly. In this way, the actuator button 24 couples to an interior portion of the master door 18 in a pivotal fashion, such that the actuator button 24 can be pushed downward in a direction as indicated by arrow E. With this downward movement, the actuator arm 25 rotates in a direction as indicated by arrow E'. Thus, the contact portion 34 contacts an upper contact surface 42 of the latch actuator 40 as the actuator button 24 is pressed downward or actuated. In this way, the latch actuator 40 is moveable between at-rest and actuated positions as shown in FIGS. 15 and 15A respectively.

As further shown in FIG. 14, the latch actuator 40 has first and second coupling portions 70, 72, which are coupled to latch pawls 80, 82, such that latch pawl 80 is associated with slave holder door 20 and latch pawl 82 is associated with master door 18. The coupling portions 70, 72 further comprise connecting pegs 74, 76 which are adapted to couple to the latch pawls 80, 82 at inclined apertures or slots 84, 86 as best shown in FIG. 15. When the latch actuator 40 is in the fully upright or at-rest position as shown in FIG. 15, the connecting pegs 74, 76 are disposed at the upper portion of the inclined apertures 84, 86 such that the latch pawls 80, 82 are fully extended laterally outward to engage latch strikers 90, 92 disposed on the door pivots 44', 45' of the L-shaped pivot arms 44, 45. When the latch pawls 80, 82 are fully extended laterally outward from the latch actuator 40, the latch strikers 90, 92 are abutted against a bottom portion of each latch pawl 80, 82, such that the console doors 18, 20 remain latched in a closed position A as shown in FIG. 1. It is noted that the latch pawls 80, 82 are gravitationally disposed to the outwardly extended position shown in FIG. 15, whether the latch strikers 90, 92 are engaged or not. When a user presses on actuator button 24 in a downward direction as indicated by arrow E, the latch actuator 40 moves vertically downward in a direction as indicated by arrow F (FIG. 14) against a latch actuator biasing spring 99 which generally biases the latch actuator 40 to the fully upright or at-rest position. As the latch actuator 40 moves downward towards the actuated position, the biasing spring 99 loads and connecting pegs 74, 76 move downward along inclined apertures 84, 86 such that the latch pawls 80, 82 retract or move inwardly towards the latch actuator 40 as indicated by arrows G. Thus, when the actuator button 24 is fully depressed, the latch pawls 80, 82 are no longer engaged with the latch strikers 90, 92 as shown in FIG. 15A and with the latch pawls 80, 82 in this unlatched position, the console doors 18, 20 are free to open.

Figure 15A:
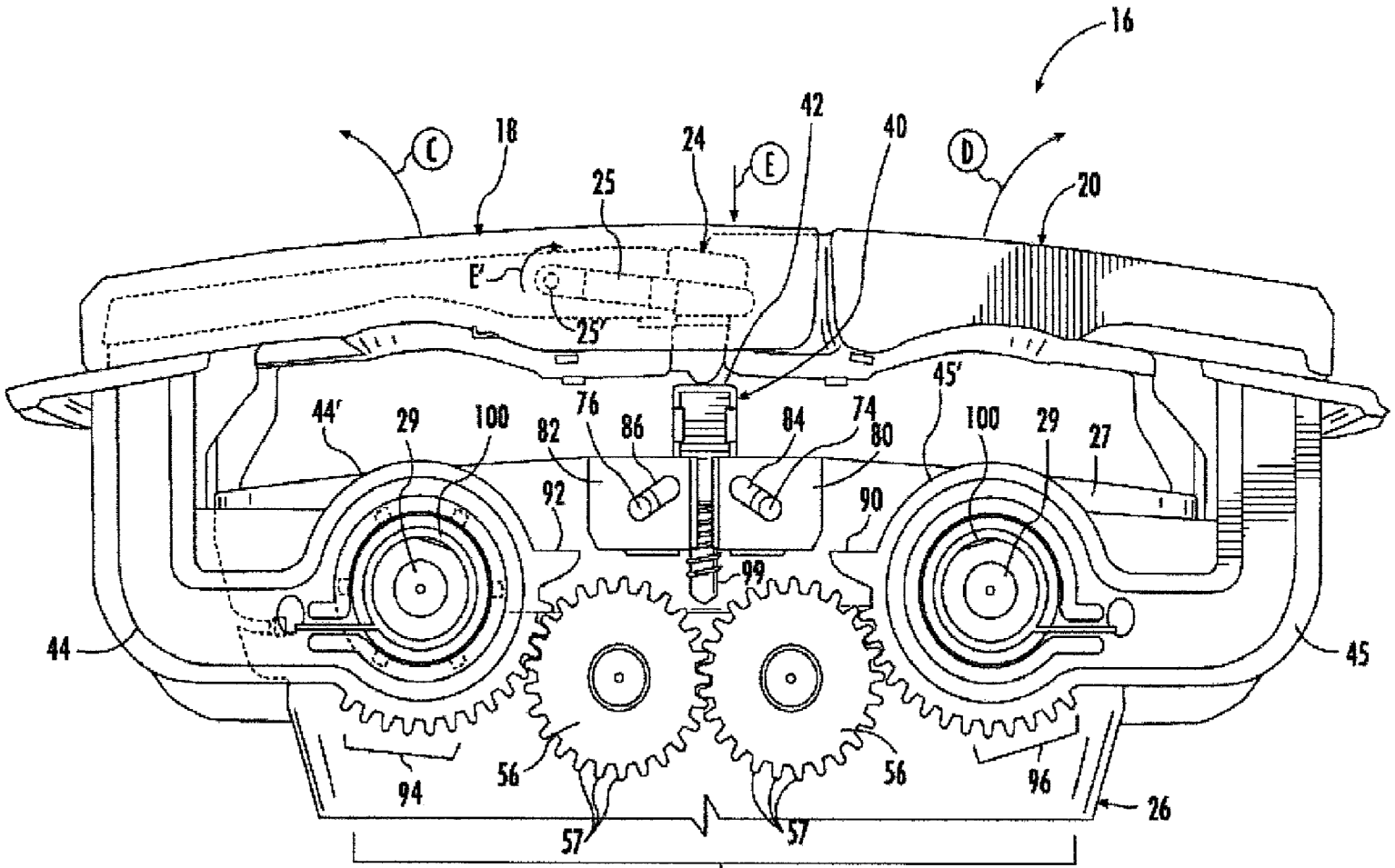
FIG. 15A is a fragmentary front elevational view of the latch mechanism of FIG. 15 in an unlatched position with the doors of the cup holder assembly in a closed position.

As shown in FIG. 15A, the circular ends or door pivots 44', 45' of the pivot arms 44, 45 comprise toothed sections 94, 96 that are adapted to engage the teeth 57 disposed on first and second cogs 56, such that a gear train 98 is formed between door 18 and door 20. As shown in FIG. 15A, the circular ends of door pivots 44', 45' of the pivot arms 44, 45 are coupled to the spindles 29 of the car-forward face 27 of the cup holder housing 26 and are further coupled to torsion springs 100 which bias the door pivots 44', 45' in opening directions as indicated by arrows $R_1$, $R_2$, shown in FIG. 14. In this way, the torsion springs 100 drive the door pivots 44', 45' in a direction which opens the console doors 18, 20 of the cup holder assembly 16. As shown in FIG. 15A, the toothed sections 94, 96 of the pivot arms 44, 45 each couple to cogs 56 which are further coupled to each other by teeth 57 to form the gear train 98. In this way, master door 18 is in mechanical or geared communication with slave door 20 such that as one door oscillates between an open and closed condition, the other will mirror such movement. In this way, the console doors 18, 20 are gearingly coupled to one another and thereby provide complimentary movement relative to one another.

Figure 15B:
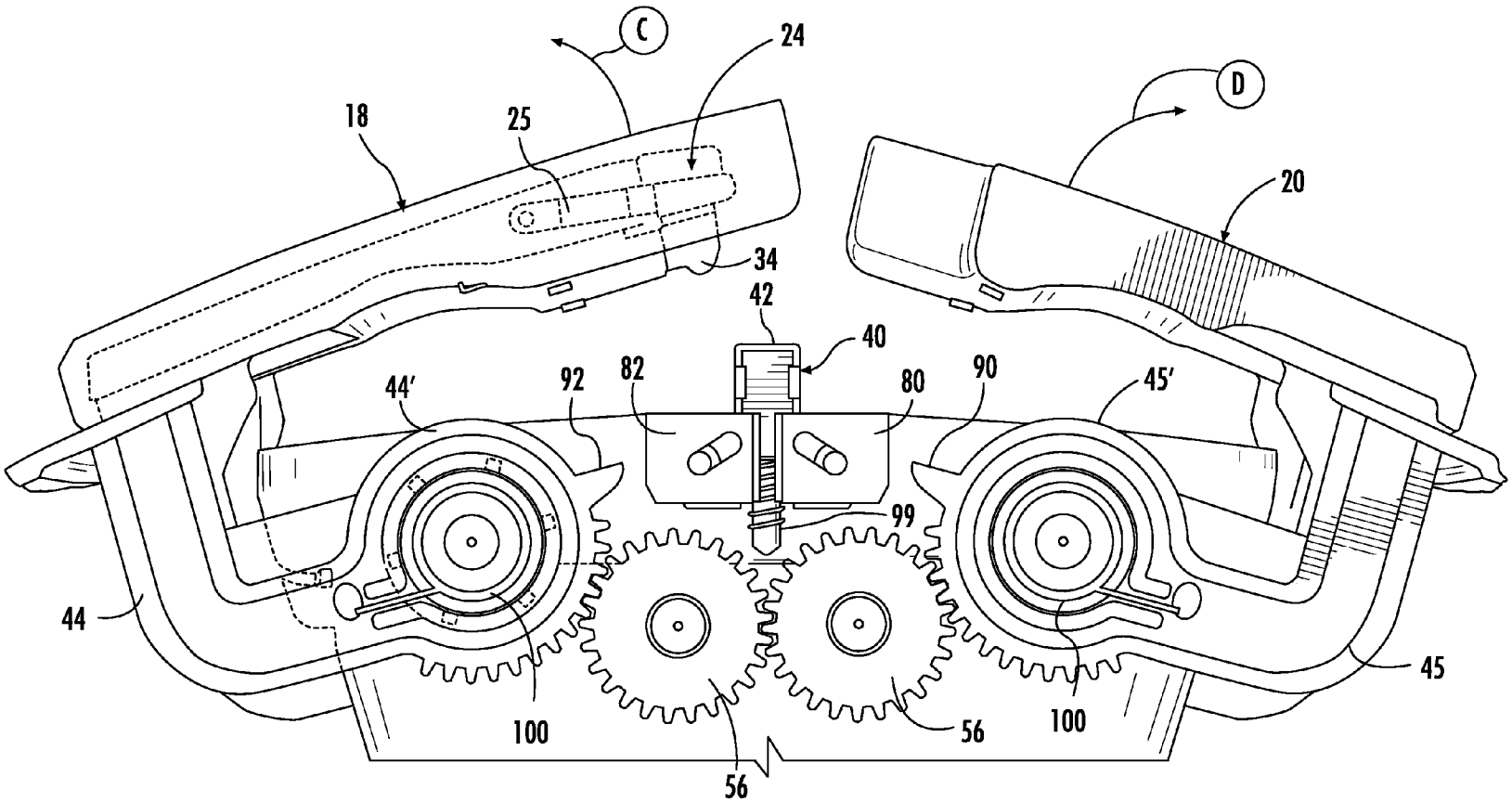
FIG. 15B is a fragmentary front elevational view of the latch mechanism of FIG. 15 with the doors of the cup holder assembly in a partially open position.

As noted above, the latch mechanism 50 is shown in FIG. 15A in an unlatched position wherein latch pawls 80, 82 are not engaged with the latch strikers 90, 92. In this unlatched position, the torsion action imparted by the torsion springs 100 will cause the console doors 18, 20 to rotate in opposite directions as indicated by arrows C and D to a partially open position as shown in FIG. 15B, and then to a fully open position as shown in FIG. 15C.

Figure 15C:
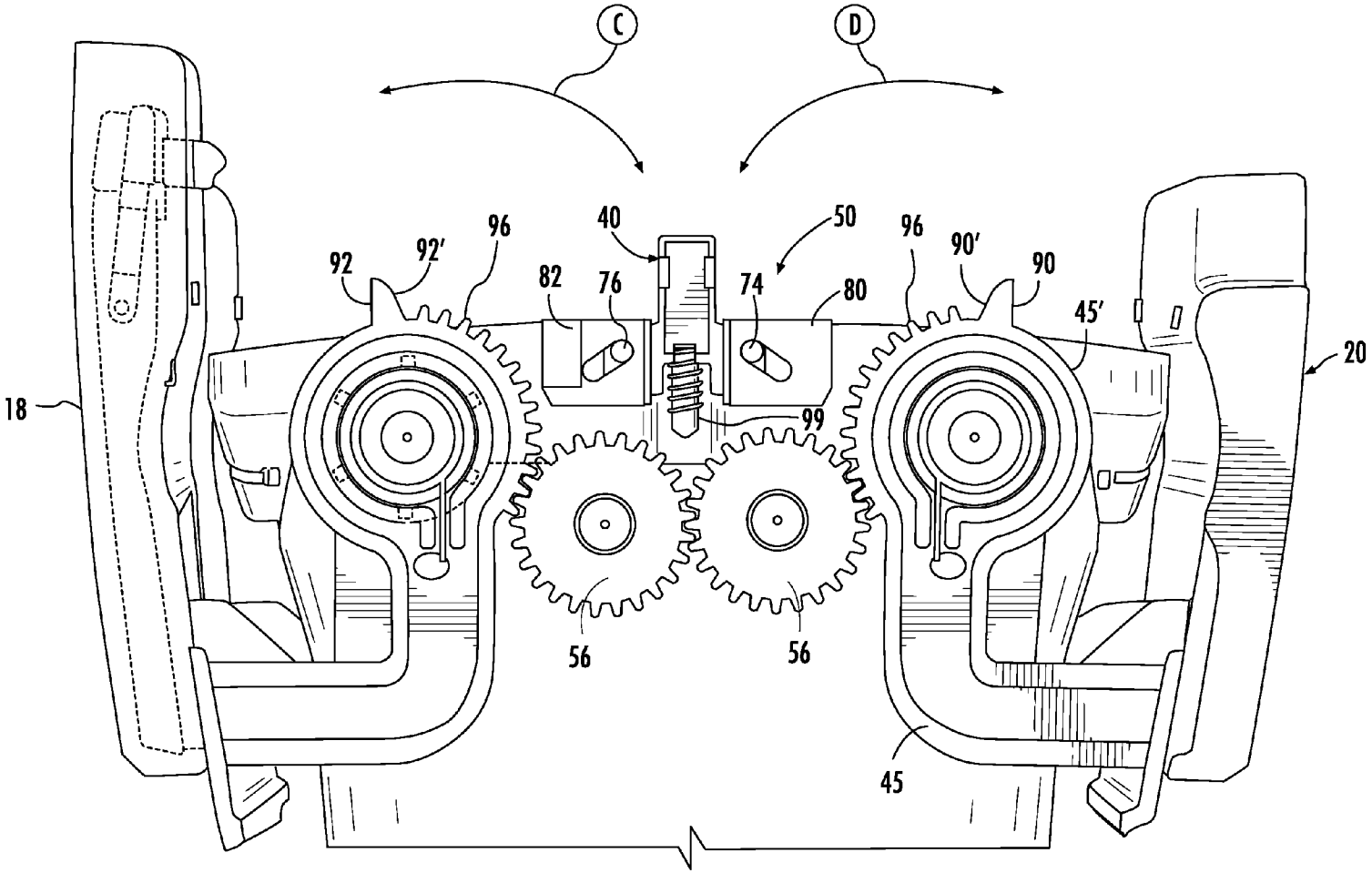
FIG. 15C is a fragmentary front elevational view of the latch mechanism of FIG. 15 with the doors of the cup holder assembly in a fully open position.

Referring now to FIG. 15C, the latch strikers 90, 92 include inclined or ramped underside portions 90', 92' which are adapted to contact the latch pawls 80, 82, respectively, thereby forcing the latch pawls 80, 82 inward, in a direction as indicated by arrow G in FIG. 14. In this way, the latch strikers 90, 92 can displace the latch pawls 80, 82 to the unlatched position, thereby allowing the latch strikers 90, 92 to rotate past the latch pawls 80, 82. Thus, when the console doors 18, 20 are closing, the latch pawls 80, 82 will have moved inwardly enough, as biased by inclined surfaces 90', 92' of latch strikers 90, 92, such that the latch strikers 90, 92 can move to a latched or closed position (FIG. 15). Once the latch strikers 90, 92 have fully rotated past the latch pawls 80, 82, the latch pawls 80, 82 will return to their gravitationally biased outward position, thereby retaining the console doors 18, 20 in a latched condition by engaging the latch strikers 90, 92. When closing the console doors 18, 20 of the cup holder assembly 16, a user must engage one of the console doors 18, 20 and move it to its closed condition which will initiate mirrored or complimentary movement of the opposite door. This is because both console doors 18, 20 are gearingly connected to the other throughout their separate ranges of motion via gear train 98. The gear train 98 ensures symmetrical movement of the doors in operation.

Further, as the console doors 18, 20 are closed, the torsion springs 100 are loaded and ready to impart a rotational force, as indicated by arrows $R_1$, $R_2$ in FIG. 14, to open the cup holder assembly 16. The torsional force imparted by torsion springs 100 also serves to keep latch strikers 90, 92 positively engaged with latch pawls 80, 82 to help reduce rattle noise and vibration during vehicle movement. Further, as the console doors 18, 20 of the cup holder assembly 16 are closed, it is contemplated that the console doors 18, 20 can be urged by a user such that the console doors 18, 20 move beyond the closed position A to a position wherein latch strikers 90, 92 are disposed well below latch pawls 80, 82. In this way, the latch pawls 80, 82 are not in contact with the latch strikers 90, 92 such that the latch pawls 80, 82 are provided with adequate room to gravitationally move outward from the upper contact surface 42 to a position wherein the latch pawls 80, 82 are prepared to engage the latch strikers 90, 92 as the console doors 18, 20 recoil under the torsional spring force imparted by torsional springs 100 to the latched or closed position A. By allowing the user to close the console doors 18, 20 to a position wherein the latch strikers 90, 92 are disposed below and not in contact with the latch pawls 80, 82, the latch mechanism 50 is adapted to consistently provide proper placement of the latch pawl 80, 82 for ensuring engagement with the latch strikers 90, 92 to secure the console doors 18, 20 in the closed position.

Figure 16:
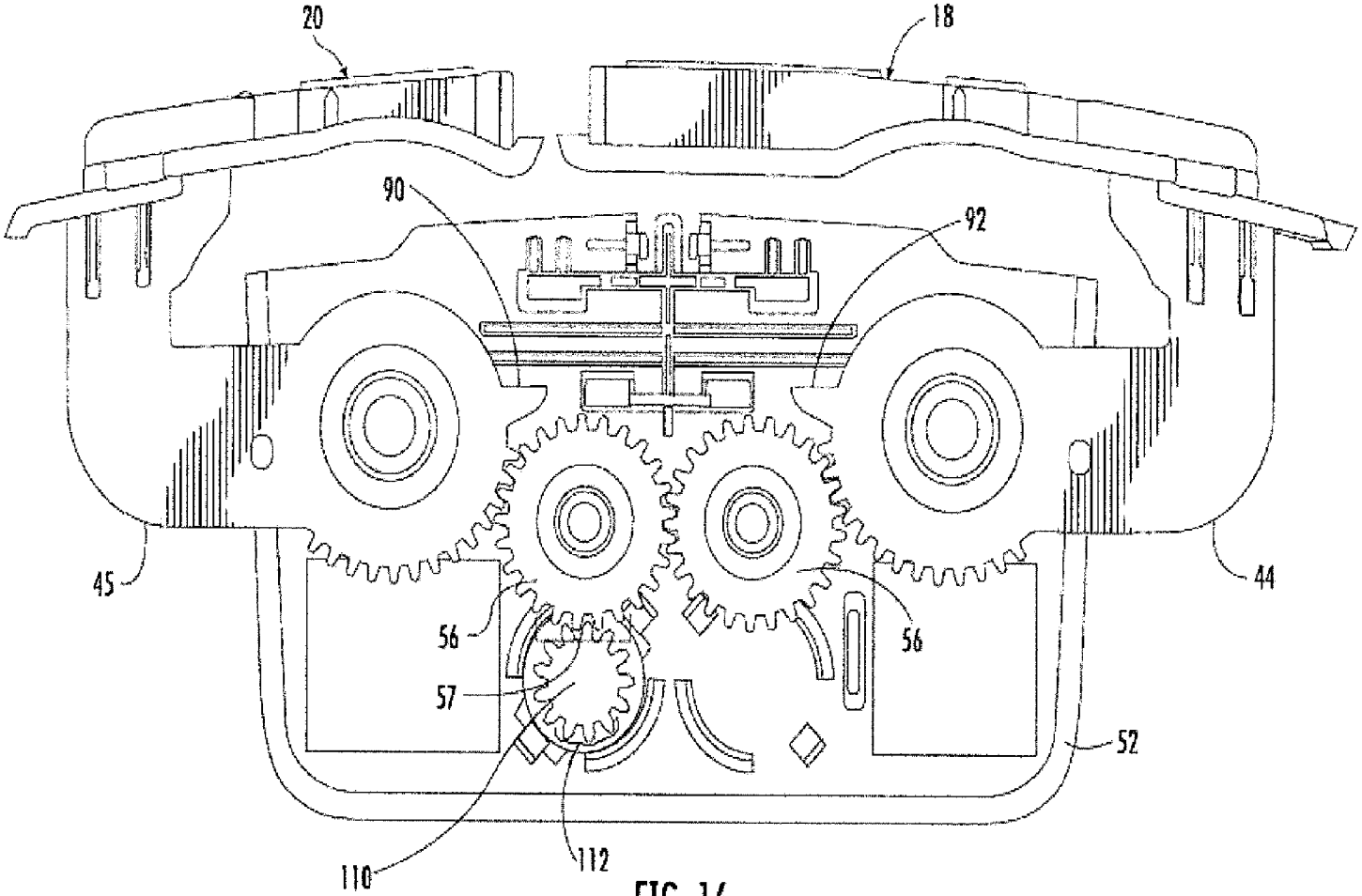
FIG. 16 is a cross-sectional view of the latch mechanism of FIG. 14 having a dampening mechanism coupled thereto.

As shown in FIG. 16, a dampener 110 can be included on the latch plate 52, wherein the dampener 110 is in communication with either cog wheel 56 such that the dampener 110 can dampen the movement of the console doors 18, 20 from a closed position A to an open position B. In this way, the torsional bias imparted by torsion springs 100 does not cause for the doors 18, 20 to open at an undesirable accelerated rate. As shown in FIG. 16, the dampener 110 comprises teeth 112 which engaged teeth 57 of cog 56. It is contemplated that the dampener 110 is a viscous dampener and one or more dampeners 110 can be used with the present invention for controlling the rate of opening for the console doors 18, 20.

Thus, the present latch mechanism incorporates a dual pawl system wherein latch pawls 80, 82 are coupled to a latch actuator 40, which is further adapted to be actuated by a actuator button 24. Actuator button 24 is used to disengage the pawls 80, 82 from latch strikers 90, 92 of console doors 18, 20. The actuator button 24 is a push button latch actuator mechanism that is substantially disposed within an interior or body portion of the master door 18, such that the actuator button 24 moves along a direction as indicated by arrow C with master door 18 between open and closed positions A and B. In this way, the present invention provides a "bomb bay" door style cup holder assembly 16 having dual console doors 18, 20 with dual latch pawls 80, 82, and dual latch strikers 90, 92 that are fully operated by one latch actuator 40 and one actuator button 24. The console doors 18, 20 are coupled together with a gear train 98 and latched via a dual latch design using a single point of actuation (actuator button 24). The single point of actuation, actuator button 24, moves with master door 18 between open and closed positions and is not a fixed actuator button disposed on the latch mechanism 50. In this way, dual latch pawls 80, 82 are separately associated with each console door 18, 20, thereby decreasing the amount of deflection in the doors in use. In other known systems, only one door will actually latch to a latch pawl in a latch mechanism, such that the other corresponding door depends entirely on a geared connection with the latching door to stay latched and in proper position while closed. Such a system leads to door deflection noted at the gap between the doors, such as gap 22 in FIG. 4. The present invention involves a dual pawl dual latch striker system such that each door is operably coupled to a dedicated latch pawl in a latched position, thereby decreasing the deflection, or the displacement of a door assembly under a load force, such that the console doors 18, 20 remain in place during use. Thus, gap 22 (FIG. 4) remains relatively constant between the console doors 18, 20 as compared to a system without dedicated latching structures for each door. The latch mechanism 50 of the present invention can reduce door deflection by up to 3-4 mm as compared to systems which latch only one door, and then rely on the gear train coupling of the doors to hold the other corresponding door in place. Such systems are susceptible to deflection between doors as forces applied to exterior surfaces of the unlatched door can generate rotational moments about the door pivots. This type of rotational moment can translate through the gear train allowing for significant deflection of the unlatched door which significantly increases the gap between corresponding doors. Thus, the ability of the latch mechanism 50 of the present invention to separately latch both console doors 18, 20 of the dual door access system reduces the total deflection in the system.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components directly or indirectly to one another. Such joining may be stationary in nature or movable in nature. Such joining may be achieved with the two components and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, and those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

It is also to be understood that variations and modifications can be made on the aforementioned structure without departing from the concepts of the present invention.

I claim:

1. A latch mechanism for a console compartment comprising:

a console housing;

an actuator coupled to the console housing having first and second pawl assemblies which are slidably supported on the housing between latched and unlatched positions;

first and second pivot arms rotatably coupled to the console housing between open and closed positions, wherein each pivot arm includes a latch striker, and further wherein the latch striker of the first pivot arm engages the first pawl assembly in the closed position and the latch striker of the second pivot arm engages the second pawl assembly in the closed position;

first and second door assemblies, wherein the first door is supported by the first pivot arm and the second door is supported by the second pivot arm, and wherein the door assemblies cooperate to cover the console compartment when the pivot arms are in the closed position and further wherein the door assemblies are moveable to an open position to allow access to the console compartment when the pivot arms are in the open position; and the latch strikers further include ramped underside portions adapted to contact and bias the latch pawl assemblies to the unlatched position as the first and second pivot arms move to the latched position.

2. The latch mechanism of claim 1, wherein:

the actuator is adapted to move between first and second positions on the console housing, wherein latch strikers are engageable with the first and second pawl assemblies when the actuator is in the first position, and further wherein the latch strikers are disengageable from the first and second pawl assemblies when the actuator is in the second position.

3. The latch mechanism of claim 2, including:

an actuator button disposed in a body portion of one of the first door and the second door, wherein the actuator button is adapted to contact and actuate the actuator between first and second positions which correlate to the latched and unlatched positions of the pawl assemblies respectively.

4. The latch mechanism of claim 3, including:

a biasing mechanism coupled to the console housing and the actuator biasing the actuator to the first position such that the pawl assemblies are correspondingly biased to the latched position.

5. The latch mechanism of claim 1, including:

first and second cogs rotatably coupled to the console housing and gearingly coupled to one another;

circular ends disposed on the first and second pivot arms and rotatably coupled to the console housing, the circular ends having toothed sections gearingly coupled to either of the first and second cogs such that a gear train is provided between the first and second pivot arms whereby movement of one pivot arm results in complimentary movement of the other.

6. The latch mechanism of claim 5, including:

a dampening mechanism coupled to the console housing and gearingly coupled to one of the first and second cogs to dampen movement of the latch mechanism.

7. The latch mechanism of claim 1, wherein:

the first and second pawl assemblies are gravitationally biased towards the latched position.

8. A latch mechanism for a console compartment comprising:

first and second pivot arms rotatable coupled to the console compartment between open and closed positions, each pivot arm having a latch striker;

an actuator coupled to the console compartment and moveable between first and second positions;

pawl assemblies supported on the actuator between latched and unlatched positions, the pawl assemblies adapted to separately engage the latch strikers of the pivot arms in the latched position;

first and second door assemblies, wherein the first door is supported by the first pivot arm and the second door is supported by the second pivot arm, and further wherein the door assemblies cooperate to cover the console compartment in a closed position, the door assemblies being moveable to an open position to allow access to the console compartment;

first and second cogs rotatably coupled to the console compartment and gearingly coupled to one another;

circular ends disposed on the first and second pivot arms and rotatably coupled to the console compartment, the circular ends having toothed sections gearingly coupled to either of the first and second cogs such that a gear train is provided between the first and second pivot arms whereby movement of one pivot arm results in complimentary movement of the other;

wherein the first and second door assemblies define a constant gap disposed there between running a length of the door assemblies when the door assemblies are in the closed position; and wherein the pawl assemblies include angled slots adapted to couple to mounting members disposed on the actuator, wherein as the actuator moves downward to the second position from the first position, the angled slots are configured to draw the pawl assemblies inward to the unlatched position where the pawl assemblies are disengaged from the latch strikers; and further wherein the latch strikers further include ramped underside portions adapted to contact and bias the latch pawl assemblies to the unlatched position as the first and second pivot arms move to the latched position.

9. The latch mechanism of claim 8, wherein:

the first and second pawl assemblies are gravitationally biased towards the latched position.

* * * * *